US011627769B2

(12) United States Patent
Kennedy

(10) Patent No.: US 11,627,769 B2
(45) Date of Patent: Apr. 18, 2023

(54) SUGARING GLOVE APPARATUS AND METHOD

(71) Applicant: Lina Kennedy, Buffalo, NY (US)

(72) Inventor: Lina Kennedy, Buffalo, NY (US)

( * ) Notice: Subject to any disclaimer, the term of this patent is extended or adjusted under 35 U.S.C. 154(b) by 111 days.

(21) Appl. No.: 15/161,115

(22) Filed: May 20, 2016

(65) Prior Publication Data

US 2018/0146724 A1 May 31, 2018

Related U.S. Application Data

(60) Provisional application No. 62/164,243, filed on May 20, 2015.

(51) Int. Cl.
*A41D 19/00* (2006.01)

(52) U.S. Cl.
CPC ..... *A41D 19/0013* (2013.01); *A41D 2600/20* (2013.01)

(58) Field of Classification Search
CPC ..... A41D 13/087; A41D 19/00; A41D 19/0013; A41D 19/0055; A41D 2600/20
USPC ..... 2/159, 161.1, 161.5, 161.7, 163
See application file for complete search history.

(56) References Cited

U.S. PATENT DOCUMENTS 474,929 A * 5/1892 Tabor ..... A41D 19/00 2/163
1,358,824 A * 11/1920 Burden ..... A41D 19/015 2/161.8
2,036,413 A * 4/1936 Herbruck ..... A41D 19/0062 174/5 SB
3,255,461 A * 6/1966 Bullock ..... A63B 71/146 2/159
3,387,306 A * 6/1968 Korey ..... A63B 71/146 2/159
4,131,952 A * 1/1979 Brenning, Jr. ..... A41D 19/015 2/124
4,408,358 A * 10/1983 Swan ..... A41D 19/0055 2/161.1
4,519,097 A * 5/1985 Chappell, Jr. ..... A41D 19/015 2/159
5,390,371 A * 2/1995 Sigward ..... A41D 19/00 2/159
5,527,244 A * 6/1996 Waller ..... A63B 23/16 482/124
5,628,069 A * 5/1997 Ebert ..... A41D 19/01547 2/161.1

(Continued)

*Primary Examiner* — Katherine M Moran
(74) *Attorney, Agent, or Firm* — Rick B. Yeager

(57) ABSTRACT

A training glove and a method for teaching proper hand, wrist, and finger orientations to efficiently perform a sugaring process for hair removal. A glove assists the technician in maintaining the proper finger positions for the application and removal of a sugar paste. In one example a glove has openings for the thumb and forefinger, and insert guides for bent finger positioning of the little finger, a ring finger, and a middle finger. In other examples, individual finger inserts are provided on the palm side of the fingers. In other examples, a single insert form is provided to position all three fingers—the middle finger, the ring finger, and the little finger. The finger inserts position the fingers so that the outside tips of the middle finger, ring finger, and little finger are properly aligned to apply an appropriate pressure to the skin in a sugaring application.

2 Claims, 17 Drawing Sheets

(56) References Cited

U.S. PATENT DOCUMENTS 6,338,163 B1 * 1/2002 Markson ..... A41D 19/0017 2/161.6
6,427,248 B1 * 8/2002 Albert ..... A41D 19/01558 2/161.1
7,210,172 B2 * 5/2007 Adams, Jr. ..... A63B 21/045 2/160
7,758,526 B2 * 7/2010 DeGould ..... A61B 5/14552 128/878
8,458,817 B1 * 6/2013 Babb ..... A41D 19/0013 2/159
9,204,675 B2 * 12/2015 Mack ..... A41D 19/001
9,248,364 B2 * 2/2016 Ramirez ..... A63B 71/146
9,781,957 B2 * 10/2017 Mack ..... A41D 19/0017
2003/0208833 A1 * 11/2003 Gold ..... A41D 19/02 2/161.1
2004/0025222 A1 * 2/2004 Cass ..... A41D 19/01564 2/159
2004/0025224 A1 * 2/2004 Albert ..... A41D 19/01558 2/159
2004/0107476 A1 * 6/2004 Goldwitz ..... A41D 19/015 2/159
2004/0123371 A1 * 7/2004 Bryant, Sr. ..... A41D 19/0013 2/159
2005/0193464 A1 * 9/2005 Hess ..... A41D 19/01582 2/160
2006/0150356 A1 * 7/2006 Tayler ..... A47L 13/18 15/227
2008/0282446 A1 * 11/2008 Komlos ..... A41D 19/015 2/167
2009/0183297 A1 * 7/2009 Drosihn ..... A41D 19/0024 2/167
2009/0307821 A1 * 12/2009 Chang ..... A41D 19/01588 2/21
2009/0324753 A1 * 12/2009 Kennedy ..... A61K 9/0014 424/725
2013/0298338 A1 * 11/2013 Kennedy ..... A61K 8/60 8/160
2014/0020152 A1 * 1/2014 Yang ..... A41D 19/0013 2/163
2014/0287882 A1 * 9/2014 Barner ..... A63B 23/16 482/47
2014/0325738 A1 * 11/2014 Marovets ..... A41D 19/0082 2/159
2017/0258624 A1 * 9/2017 Butler ..... A61F 5/05866

* cited by examiner

Step 100 Hand to skin ("handshake")

Step 200 Bring the sugar paste ("molding/massaging")

Step 300 Drop the wrist ("relax pressure")

Step 400 Release from the sugar paste ("airplane")

Repeat Steps 100-400

Step 500 Roll past the sugar paste ("prepare to flick")

Step 600 Kick-off ("flick")

Step 700 repeat kick-off ("snap-back")

FIG. 2

STEP 1 Handshake Position

Establish position. Establish pressure.

STEP 2 Bring the Sugar Paste

Slightly scoop/flex/position your hand backward. Keep sugar paste on the skin, not in your hand/palm by placing your thumb close to the bottom of your fingers. Begin to bring the sugar paste while keeping the equal pressure on all 3 fingers that you established in #1. Stop bringing the sugar (molding it into the skin) when you have reached the end of the sugar paste you were applying to the skin.

STEP 3 Relax

Release pressure without removing hand from sugar paste and drop your wrist forward - not your hand. Keep fingers same position, and drop your wrist down and towards you. DO NOT CHANGE YOUR FINGERS' POSITIONING and do not move your hand forward yet.

STEP 4 Release Hand from Sugar Paste

Start to release hand from sugar paste strip. Continue releasing hand from sugar paste in an airplane take-off method. Do not go straight up like a helicopter.

STEP 5 Roll Past the Sugar Paste Strip

On your third time molding of S-2 (bringing the sugar paste), stop your hand 3/4 of the way up the sugar paste strip. Perform S-3, and in that S-3 hand position and reduced pressure, "roll" your hand to the end or just past the edge of the sugar paste strip. Stay connected to the sugar paste using S-3 pressure.

STEP 6 KICK-OFF (Kick - One - Off)

Once you begin S-6, COMMIT. Do not stop in the middle of S-6

KICK. Keep your hand moving forward just a little bit... It is like a continuation of S-5.

ONE. Go into S-1 position and do not stop moving your hand forward. (There is little movement in position change from S-1 to S-2, therefore you must pay attention to ensure you are in S-1 and not S-2 position during S-6.

OFF. This is the action of sending your hand firmly forward in a parallel motion to the skin.

SNAPBACK

Recover the sugar paste immediately after performing the OFF of S-6 by "snapping your wrist back towards you".

Snapback your hand to the exact spot you want to return to by stopping your hand at that specific spot.

Then drape down the sugar paste so that it becomes compiled into a small area.

Position your hand in S-1 just behind the compiled sugar paste and establish S-1 Pressure again.

Do not move your hand forward yet.

Perform S-3 again. Do not move your hand forward yet.

Perform S-6 a) KICK --- b) ONE S-1 Position --- c) OFF

Do not stop until you performed the "OFF".

Repeat S-1, S-2, S-6 until all the sugar paste strip is removed from the skin.

FIG. 23

SUGARING GLOVE APPARATUS AND METHOD

RELATED APPLICATIONS

This US non-provisional application is related to U.S. Provisional Application No. 62/164,243 filed May 20, 2015 by applicant and claims the priority of that filing date.

FIELD OF INVENTION

The present invention relates to a training device and training method for applying a sugar composition for hair removal.

BACKGROUND

Traditionally, hair removal has been performed by waxing. This is typically done in a salon by a body wax professional using hot or cold wax applied to the hair which the clients wish to have removed. The waxing products are made of petroleum based resins and chemicals which can be prone to contamination or cross contamination. With hot waxing, there are risks of burning skin, damaging the dermal cells, scarring the follicle mouth or surrounding area and causing pigmentation. The wax will adhere to the skin cells, or any surface it is applied to, making pulling it away painful. When waxing, you remove the unwanted hair against the natural direction of growth which causes undue levels of pain and becomes the major contributor to ingrown hair. Hair trapped under the skin which can also be painful and unsightly and cause infections.

A hair follicle is a skin organ that produces hair. Hair production occurs in phases, including a growth phase (anagen), and cessation phase (catagen), and a resting phase (telogen). Stem cells are principally responsible for the production of hair.

Anagen is the active growth phase of hair follicles. The roots of the hair are dividing rapidly, adding to the hair shaft. During this phase, the hair grows about I cm every 28 days. Scalp hair stays in this active phase of growth for 2-7 years. The amount of time the hair follicle stays in the anagen phase is genetically determined. There are other factors that can affect hair growth and hair loss patterns such as disease, medication, stress, and severe dieting. Generally, genes play the major role. At the end of the anagen phase, the follicle goes into the catagen phase.

SUMMARY OF INVENTION

"Advanced body sugaring" is a unique and innovative process for the removal of unwanted facial and body hair for men, women and children alike.

In some examples, the methods of the current invention are performed by trained professionals in advanced body sugaring and skin conditioning treatments through salons and spa therapy facilities. In other examples, the methods may be performed at home.

Sugaring requires an entirely different mind-set and approach than for waxing. In the methods described, the all natural sugaring compositions do not adhere to live skin cells, therefore, when the compositions are removed, the composition gently exfoliates dead skin cells and leaves behind freshened skin. There is no after pain, stickiness, bruising or burning.

In one example, the sugaring compositions comprise pure sugar, water and lemon. They are edible and delicious, and since they are water soluble, can easily rinsed away if accidentally applied to an area. The sugaring will extract all hair colors and textures. The sugaring methods remove the hair in the natural direction of the hair growth.

When the sugar paste is applied, it seeps into the hair follicle and helps lubricate that hair root. The sugaring process will successfully treat all skin types and colors while improving skin tone and texture. Sugaring will eliminate ingrown hairs, and help prevent new ingrown hairs from developing. Since sugaring is done at body temperature, and requires no heat, the process eliminates the risk of burning the skin. The treatment adheres to the hair, not to the skin, and lubricates the root for easier removal from the hair root.

These factors, combined with the hair removal in the natural direction of growth, create a much more comfortable experience for everyone.

Theory

The Kennedy Theory® for sugaring hair removal using Alexandria Professional® (AP) sugar paste formulations in conjunction with the Kennedy Sugaring Technique Theory™ is as follows:

In one embodiment, the AP sugar paste formulation is applied using the Kennedy Sugaring Technique Application as described in Step 200 below—the "molding process". This application technique allows the sugar paste to penetrate down into the follicle and to lubricate the hair inside as well as to grip the hair and inner root sheath. Basically, the sugar is sticking to everything on the inside of the follicle that it touches.

Taking a hair in the early anagen stage promotes a faster refinement (thinning) and depletion of the hair, so that the amount of hair and difficulty of removal decrease in subsequent sugaring treatments. When a hair is extracted intact and in its natural direction while in the anagen stage, it has a large bulb traveling through the follicle which takes some of the inner root sheath with it as it is being extracted. The inner root sheath also carries matrix cells responsible for helping to grow the hair. We are all born with a predetermined amount of matrix cells, and by depleting the follicle's inner root sheath time and time again, you help to deplete the hairs growth source.

In addition to the Kennedy Theory®, when you extract a hair in the early anagen stage, you are taking the hair while it is still attached to the derma papilla—its feeding source/nourishment from blood vessels.

Applicant theorizes that extracting a hair in the early anagen stage causes the vessels to be cauterized. Cauterization may also occur instantly from time to time whereby there are no more vessels to continue the nourishment to a given follicle. This explains a reason why sometimes a hair never grows back after a single treatment.

Applicant theorizes that sometimes only some of the vessels become cauterized, and that this partial cauterization is the reason why we see instant refinement results and ongoing refinement results. This phenomena is generally observed if the hair is treated in the early anagen stage which means treatments when the hair is quite short such as ½ mm up to 2 mm.

The length of hair also depends primarily on the location of the hair on the body.

These theories extend the Kennedy Theory®, to explain why the Alexandria Professional® System is successful at providing immediate excellent instant staggered growth and hair refinement—all leading to permanent results.

BRIEF DESCRIPTION OF DRAWINGS

FIG. 2 is a flow chart illustrating an example sugaring technique for hair removal.

FIG. 23 summarizes the 6 Steps to Perfect Sugaring.

DESCRIPTION OF EMBODIMENT

Figure 1:
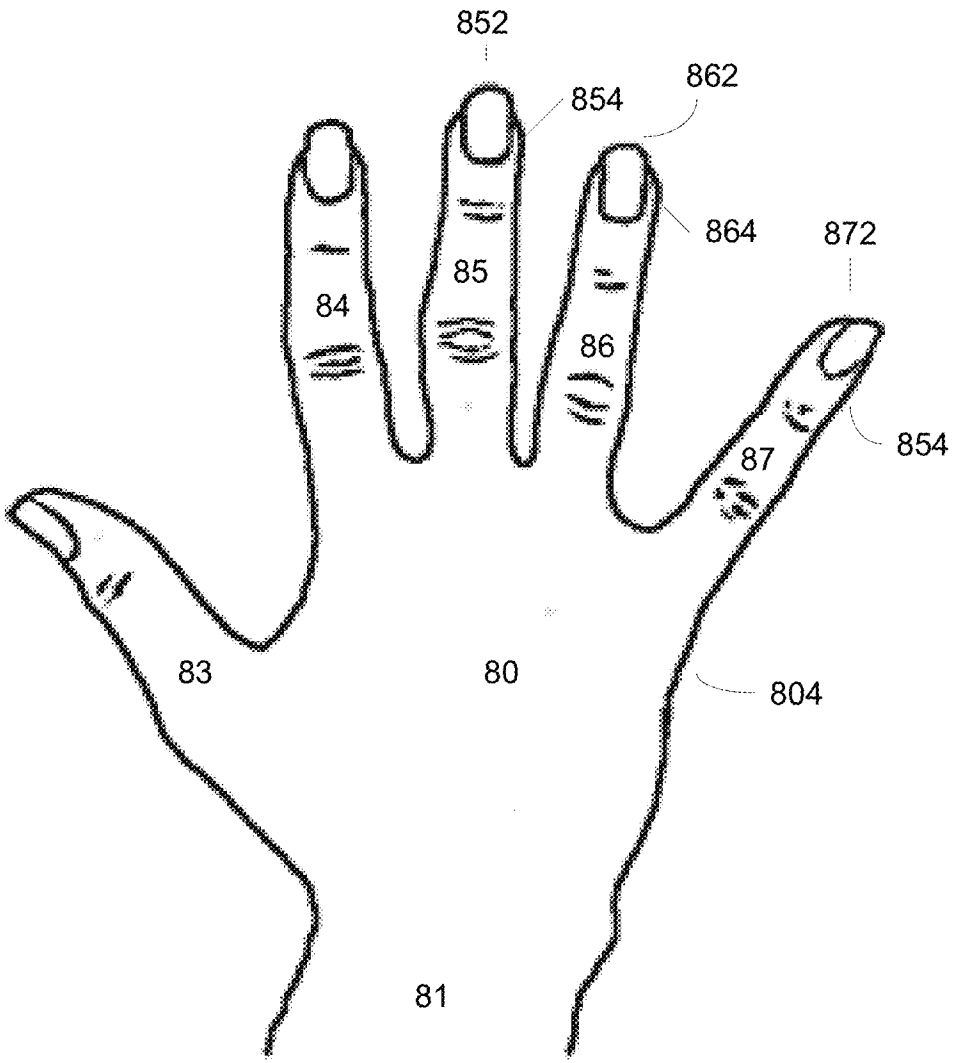
FIG. 1 is a top view of an open right hand.

FIG. 1 is a top view of an open right hand 80 the wrist 82, the index finger 84, the middle finger 85, the ring finger 86, little finger or baby finger 87, and thumb 83.

Example—Alexandria Professional® Sugaring Technique

Sugaring treatments cause hair to quickly become less resistant to extraction.

With the Alexandria Professional® sugaring technique, the sugar paste is seeped into the follicles and then removed with a "flicking" action in the natural direction of the hair growth. This action actually extracts hair in the early anagen stage while simultaneously removing debris from the follicles and gently exfoliating the skin as well. Extraction of hair in the early anagen stage, when the hair is generally 1/16" (less than Imm) in length, promotes quicker refinement that leads to diminishment.

Sugaring is an excellent method to refine and diminish hair growth, and simultaneous benefits occur with each treatment. As the sugar paste is molded onto the skin, it naturally seeps into the follicles and sticks to and grips everything it touches inside the follicle including the root of the hair, the debris accumulation from the skin's surface that can become embedded in the follicle, and the inner root sheath carrying matrix cells.

When the quick "flick" action is performed, the sugar paste inside the follicle connected to the sugar paste molded onto the skin is all removed at the same time—taking with it all that is connected to it inside and out. This action is very gentle because the sugar paste acts as a lubricant inside the follicles which allows for a more gentle extraction and allows for the extraction of hair in the natural direction of its growth.

Comodones (blackheads or compacted pores) can also be gently and safely treated with the Alexandria Professional's unique sugaring technique. As described above, the Mud Puddle will help to draw more impurities from the pores in between sugaring treatments.

6 Step Sugaring Technique

The following description is of an improved sugaring technique which can be used in a stand alone fashion, but which has enhanced results as part of an overall skin conditioning program. This description is directed at an instructor who is teaching skin care professionals how to use the technique in salons. The technique may also be used at home.

FIG. 2 is a summary of a 6 step sugaring technique used in one embodiment of the current invention.

Before You Start—Confirming Hand Position

Standing across from each student at the massage table, shake hands with one student at a time and ask them to release from the handshake by dropping the hand to the table. Observe how they place their hand when it reaches the table. Repeat this action until their hand is in the correct handshake position as it reaches the table. Have them observe your hand as it reaches the table so they can mimic it. This is to establish the correct hand position to begin treatment and the correct hand position to "flick" (remove) the sugar off the skin.

You should never be seeing the top off your hand when in the "hand shake" position.

Step 100 Hand to Skin ("Handshake Position")

Figure 3A:
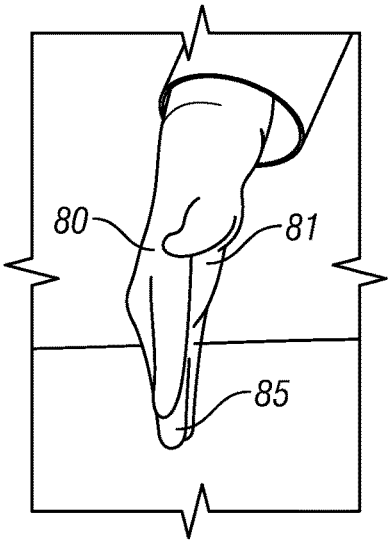
FIG. 3A is a front view illustration of a hand and wrist the "handshake position" of Step 100 of the flow chart of 2.
Figure 3B:
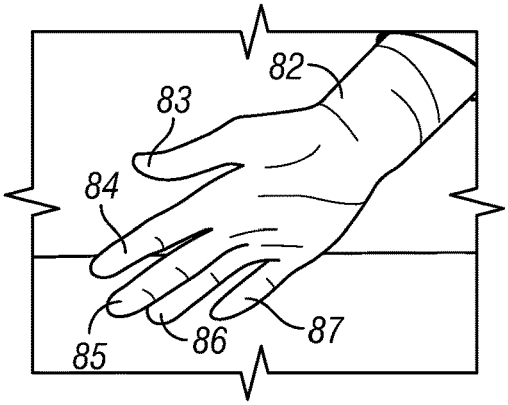
FIG. 3B is a side view showing the finger and wrist alignment, and finger separation of FIG. 3A.

FIG. 3A is a front view illustration of a hand 80 and wrist 82 in a "handshake position" of Step 100 of the flow chart of FIG. 2. FIG. 3B is a side view showing the finger and wrist alignment, and finger separation of FIG. 3A where the middle finger 85, ring finger 86, and baby finger 87 are applying equal pressure. FIGS. 3-8 show hand positions without sugar paste. FIGS. 9-17 show the hand position with sugar paste 92 applied to a portion of a leg 90.

In FIG. 3A, the index finger 84 and thumb 83 are not applying pressure. In FIGS. 9-17, the index finger and thumb are used to help contain the sugar paste.

At step 100, the technician places the sugar paste on the client. The sugar paste is placed on the client's skin with the technician's sugaring hand. The sugar paste is placed on the client's skin, and not in the palm of the technician's hand. The sugar paste is confined to the inside of the technician's fingers and is not present behind the technician's fingers. A controlled and moderate pressure of the technician's fingers 85, 86, and 87 and hand is maintained on the client's skin. In this example, the index finger 84 is not used to apply pressure to the skin. In other examples, the index finger is used to apply equal pressure as the middle finger 85, ring finger 86, and baby finger 87. The thumb 83 of the technician's sugaring hand is used to keep the sugar paste rolling onto the client's skin so that the sugar paste does not move to the technician's palm 81.

Figure 9:
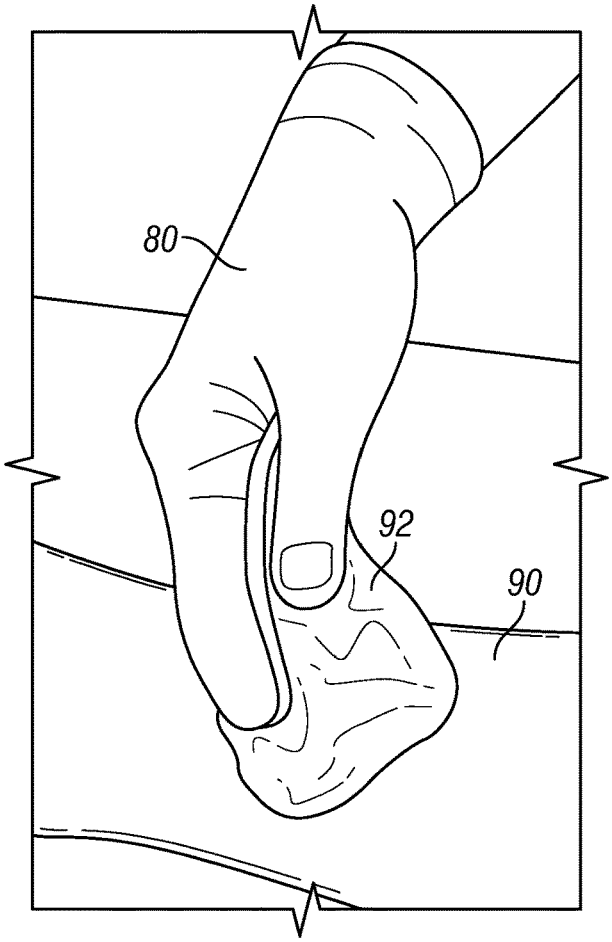
FIG. 9 is a front view illustration of a hand and wrist the "handshake position" of Step 100 of the flow chart of 2 with sugar paste.

FIG. 9 is a front view illustration of a hand 80 and wrist the "handshake position" of Step 100 of the flow chart of 2 with sugar paste 92. If this step is performed correctly, then there is good penetration and seeping of the sugar paste into the follicles; and the technician is prepared to make an effective and comfortable application of the paste.

Step 200 Bring the Sugar Paste ("Molding/Massage")

Figure 4:
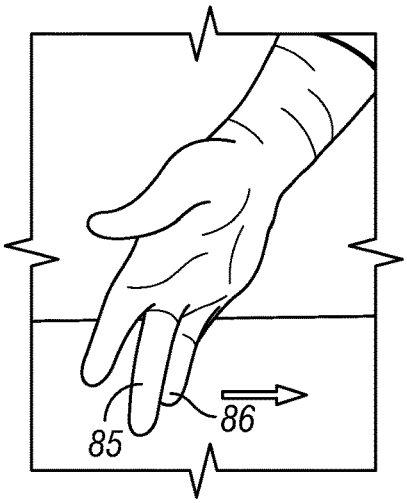
FIG. 4 is a front view showing the finger and wrist alignment of the sugar paste "molding" of Step 200 of the flow chart of FIG. 2.

FIG. 4 is a front view showing the finger and wrist alignment of the sugar paste "molding" of Step 200 of the flow chart of FIG. 2.

Figure 10:
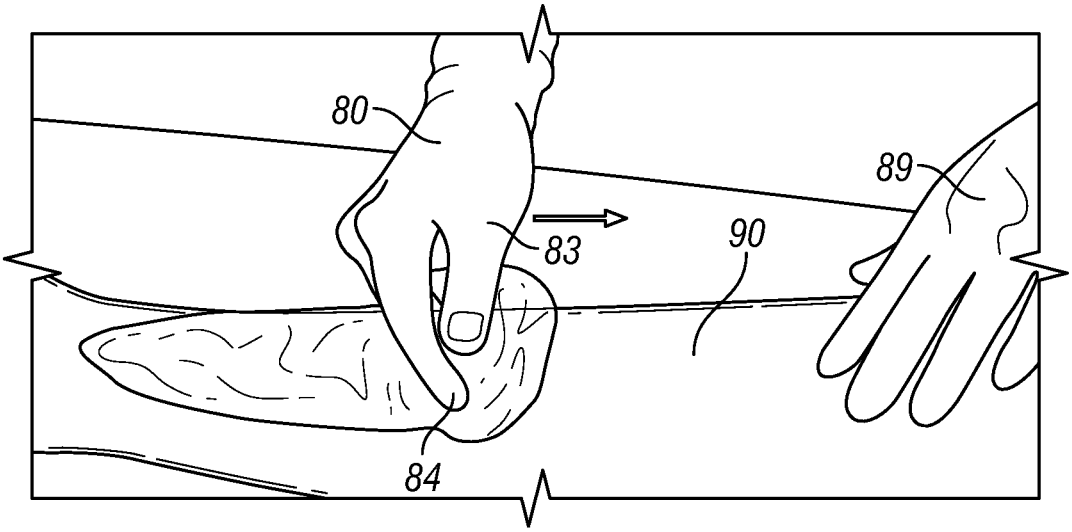
FIG. 10 is a front view showing the finger and wrist alignment and sugar paste of the sugar paste "molding" of Step 200 of the flow chart of FIG. 2.

FIG. 10 is a front view showing the finger and wrist alignment and sugar paste 92 of the sugar paste "molding" of Step 200 of the flow chart of FIG. 2. The technician's second hand 89 is used to tighten the skin on the leg.

At step 200, the technician maintains a hand position similar to Step 1, with the exception that the technician needs to control the wrist in order to bring the sugar forward. The thumb 83 of the sugaring hand is used to keep the sugar paste 92 off the palm and down on the skin and to keep the sugar paste rolling onto the skin as the technician applies the sugar paste. An even pressure is maintained on all fingertips being used to sugar, and the even pressure helps to keep a solid control of the wrist. The even pressure and wrist control facilitates an even application of the paste. The technician should spread the fingers of the application hand for smoother equal application whilst keeping the fingers in a parallel line to each other. If the fingers are kept too tightly close together, it will affect the application, the time it takes to complete the treatment, especially of legs and arms, and the comfort of the application.

Step 300 Drop Your Wrist ("Relax/No Pressure")

Figure 5:
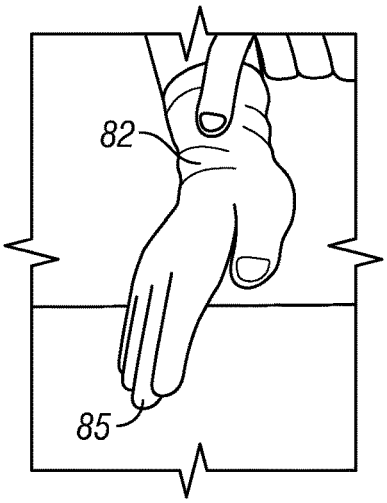
FIG. 5 is a front view showing the finger and wrist alignment of the "relax" wrist dropping of Step 300 of the flow chart of FIG. 2.

FIG. 5 is a front view showing the finger and wrist alignment of the "relax" wrist dropping of Step 300 of the flow chart of FIG. 2.

Figure 11:
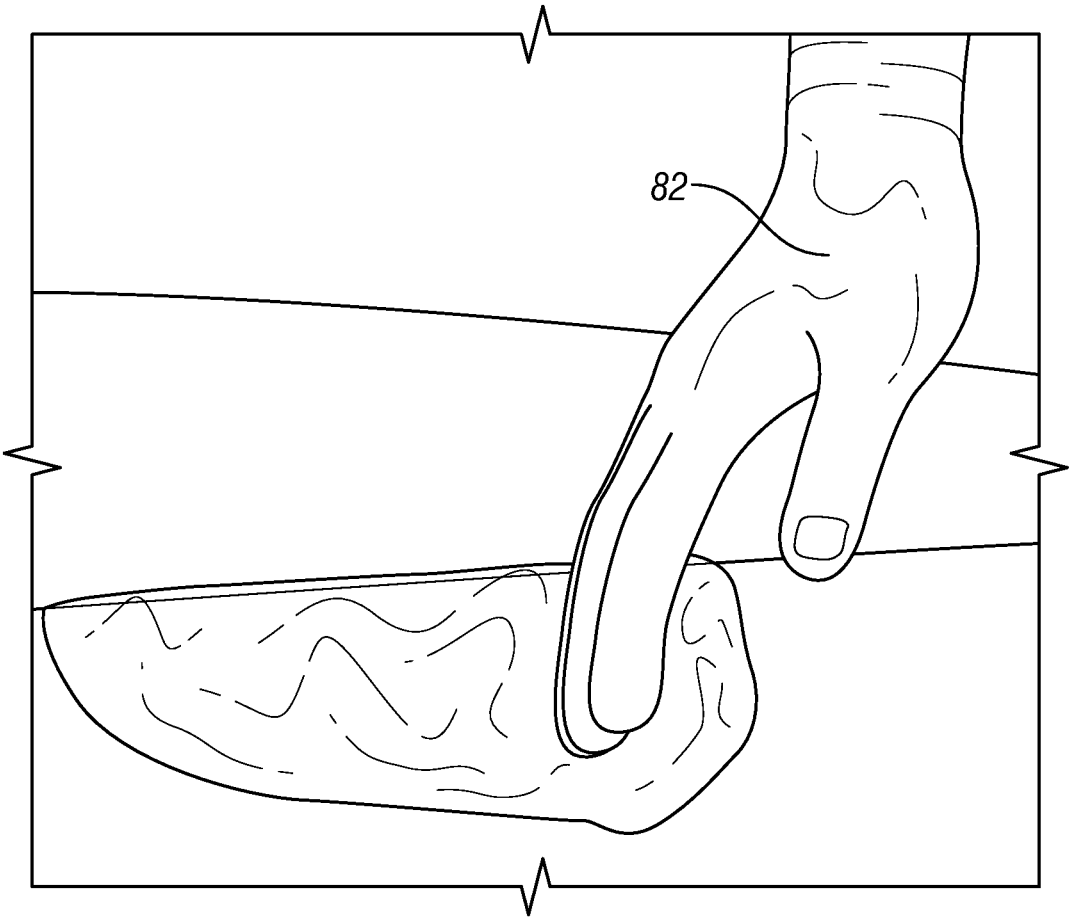
FIG. 11 is a front view showing the finger and wrist alignment and sugar paste of the "relax" wrist dropping of Step 300 of the flow chart of FIG. 2.

FIG. 11 is a front view showing the finger and wrist alignment and sugar paste of the "relax" wrist dropping of Step 300 of the flow chart of FIG. 2.

At step 300, the technician immediately stops the application and molding of the sugar paste; and prepares for steps 400, or for steps 500 and 600. As described below, steps 100-400 will typically be repeated once or twice before steps 500 and 600 are executed. If this step is performed incorrectly, then the client may experience discomfort or pain during the release; or may experience discomfort or pain and broken hair when "flicking".

Step 400 Release from Sugar Paste ("Airplane")

Figure 6:
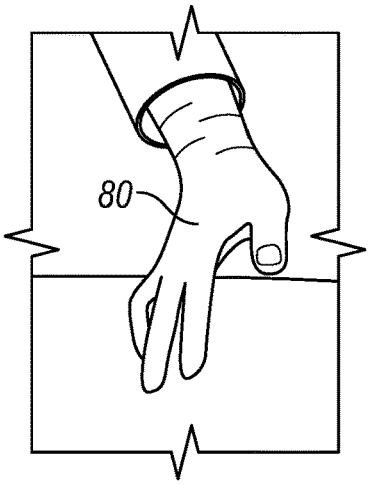
FIG. 6 is a front view showing the finger and wrist alignment of the "airplane" release of Step 400 of the flow chart of FIG. 2.

FIG. 6 is a front view showing the finger and wrist alignment of the "airplane" release of Step 400 of the flow chart of FIG. 2.

Figure 12:
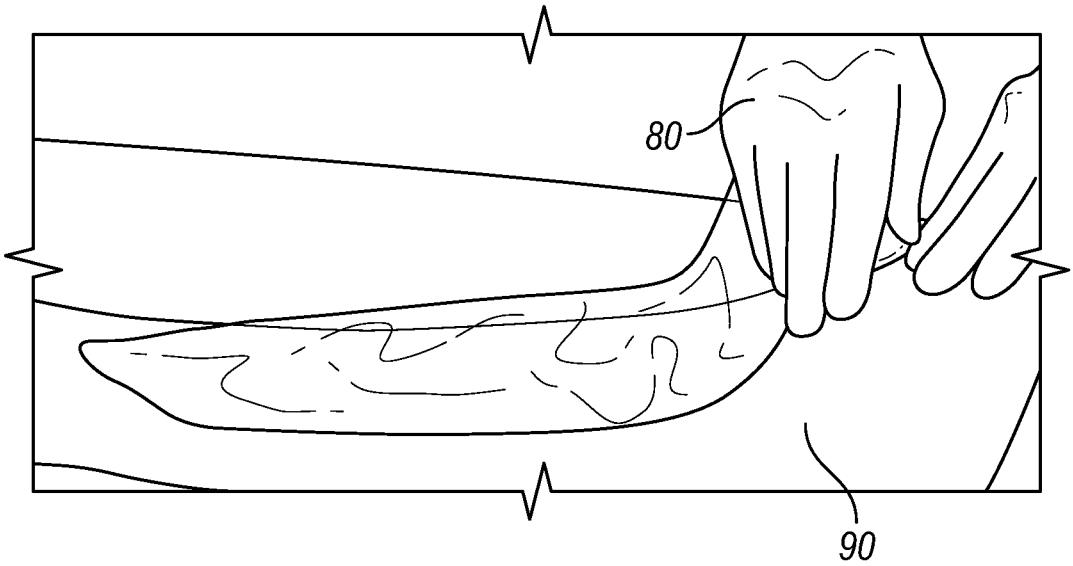
FIG. 12 is a front view showing the finger and wrist alignment and sugar paste of the "airplane" release of Step 400 of the flow chart of FIG. 2.
Figure 13:
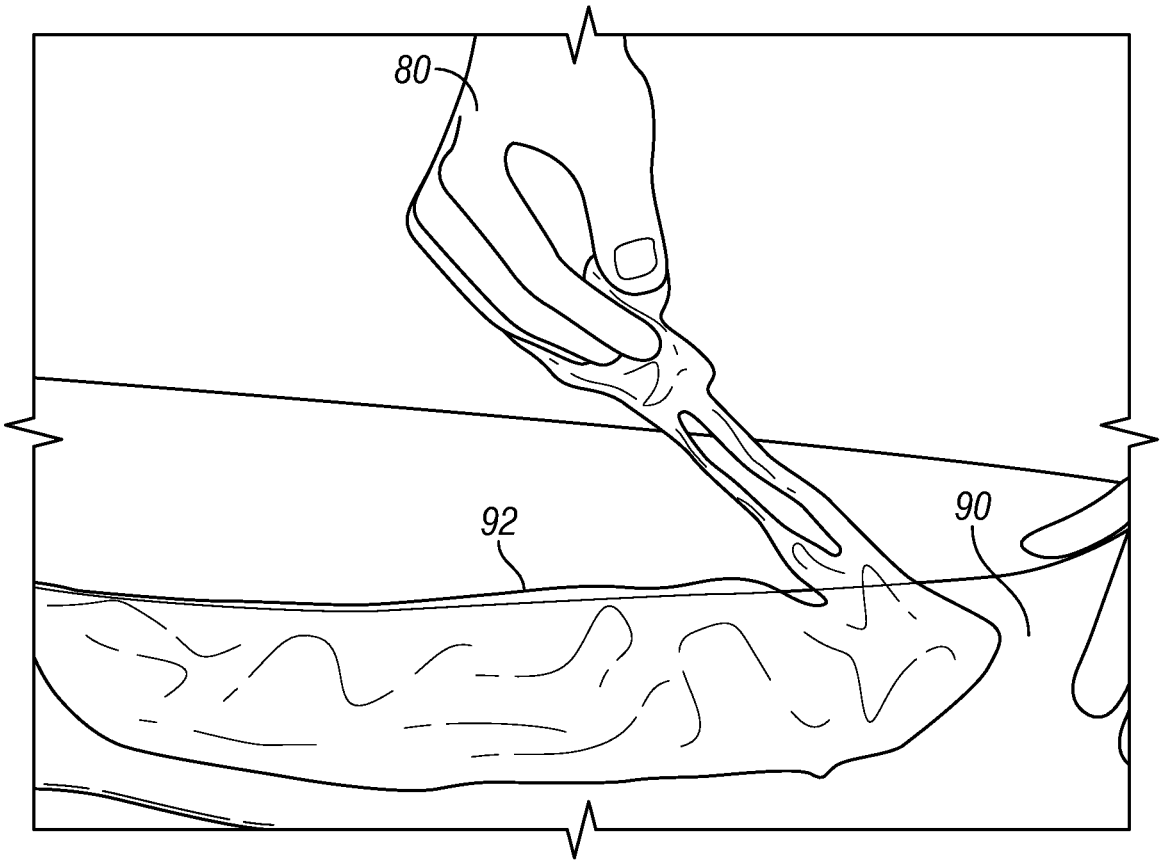
FIG. 13 is a front view showing the raised hand of the "kick off" of Step 600 of the flow chart of FIG. 2.

FIG. 12 is a front view showing the finger and wrist alignment and sugar paste of the "airplane" release of Step 400 of the flow chart of FIG. 2.

At step 400, the technician releases the hand from the sugar paste without lifting the skin by executing an "airplane take-off" action—NOT a helicopter. The technician is then properly positioned to repeat steps 100 and 200. If this step is performed incorrectly, then the technician can lift the client's skin or pull the client's hair and cause pain during release. The airplane take off analogy provides a reminder to the technician to execute a release with the application hand at an acute angle to the skin without abruptly cutting away from the sugar paste.

Repeat of Steps 100-400

Figure 14:
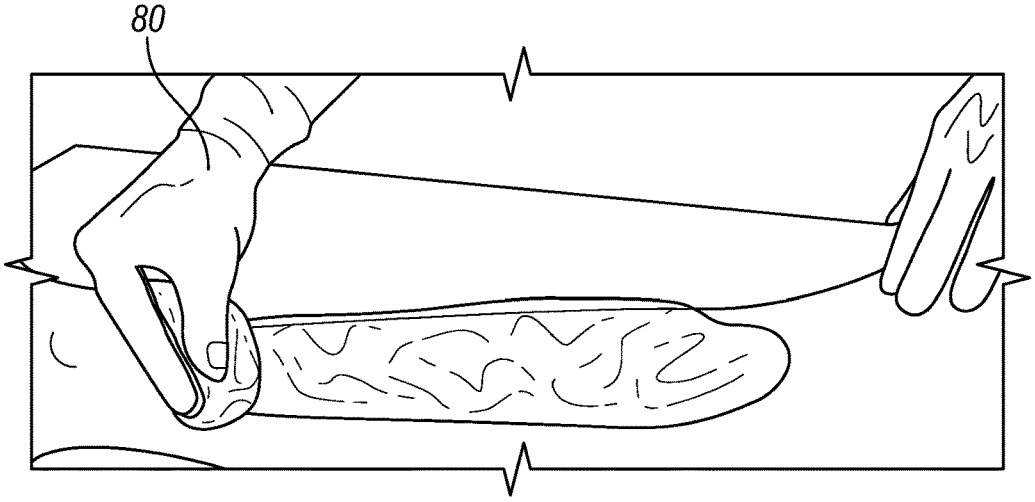
FIG. 14 is a front view showing the return to a handshake position following the "kick off" of FIG. 13.
Figure 15:
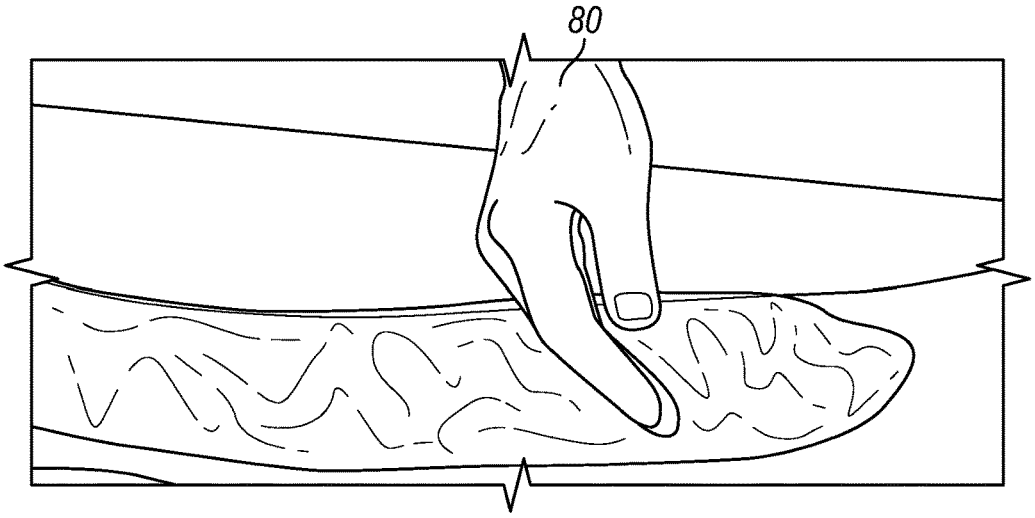
FIG. 15 is a front view showing the molding following the "kick off" and return to a handshake position of FIG. 14.
Figure 16:
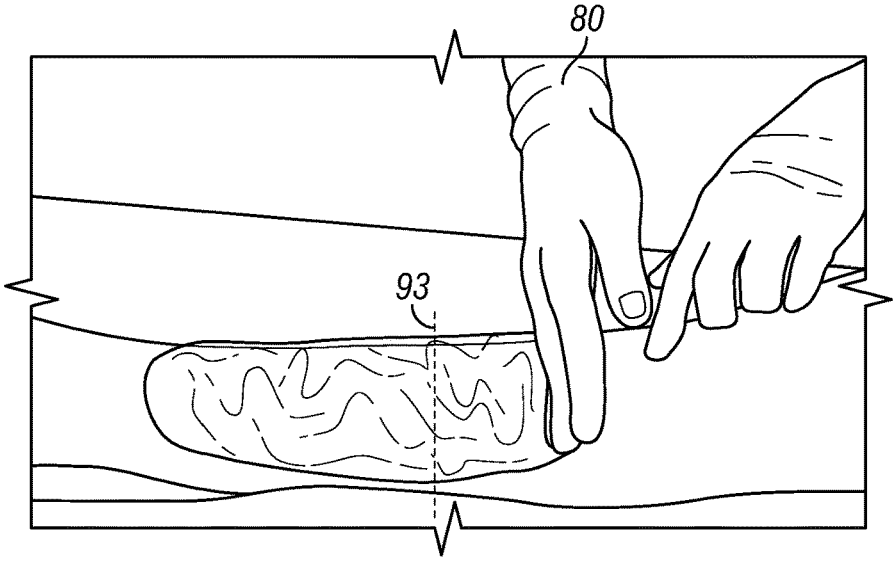
FIG. 16 is a front view showing the "roll" and return to a handshake position to "prepare to flick" following the "molding" steps of FIG. 14.

It is generally desirable to repeat the "molding" process once or twice over a region of skin before flicking off the sugar paste. This repeated molding helps to work the sugar into the follicles for better hair removal. FIGS. 14-16 illustrate a repeat of steps 100-200. FIG. 14 is a front view showing the return to a handshake position following the "kick off" of FIG. 13. FIG. 15 is a front view showing the molding following the "kick off" and return to a handshake position of FIG. 14.

Step 500 Roll Paste Sugar Paste ("Prepare to Flick")

Figure 7A:
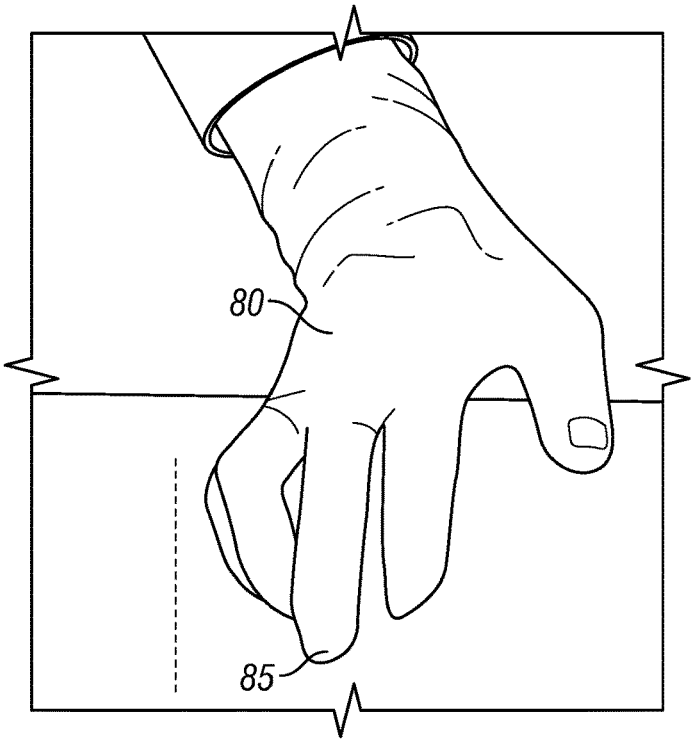
FIG. 7A is a front view showing the finger and wrist alignment of the "roll" of Step 500 of the flow chart of FIG. 2.

FIG. 7A is a front view showing the finger and wrist alignment of the "roll" of Step 500 of the flow chart of FIG. 2.

Figure 7B:
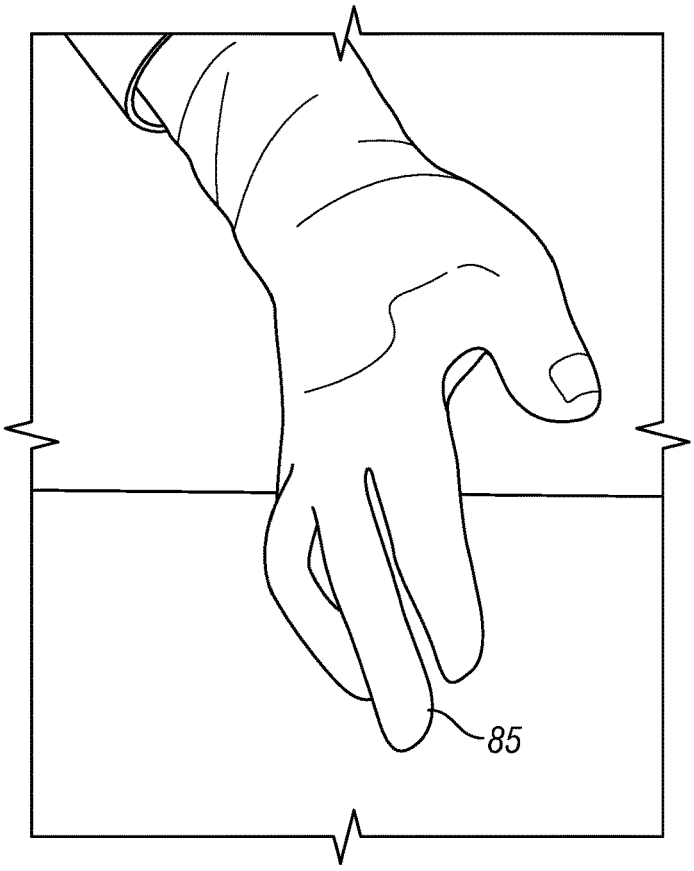
FIG. 7B is a front view showing the finger and wrist alignment of the "prepare to flick" of Step 500 of the flow chart of FIG. 2.

FIG. 7B is a front view showing the finger and wrist alignment of the "prepare to flick" of Step 500 of the flow chart of FIG. 2.

FIG. 16 is a front view showing the "roll" and return to a handshake position to "prepare to flick" following the "molding" steps of FIG. 14.

The sugar paste is not removed during this step. Step 500 should be performed correctly in order to prepare for step 600. The purpose for performing step 500 is to allow the technician to stop with the pressure of step 200 after they have come to step 300, and to "roll past" the applied sugar on the skin while reducing their contact pressure by 50% and continuing to roll on the applied sugar to get to the end of the applied sugar paste. The technician continues to apply equal pressure to all fingers on the application hand. The technician prepares for the "kick-off" (Step 600) by connecting to the end of the sugar paste application. This is similar to removing a piece of tape, by gripping the very edge of the tape to remove it.

Step 600 Kick-Off ("Flick")

Figure 8:
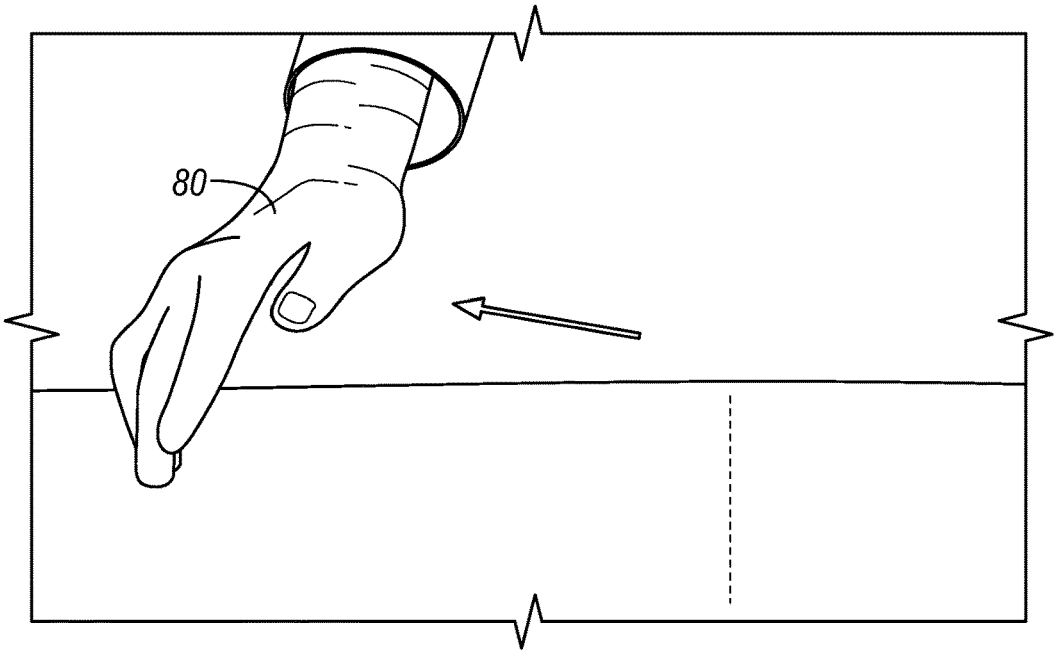
FIG. 8 is a front view showing the finger and wrist alignment of the "kick off" of Step 600 of the flow chart of FIG. 2.

FIG. 8 is a front view showing the finger and wrist alignment of the "kick off" of Step 600 of the flow chart of FIG. 2.

Figure 17:
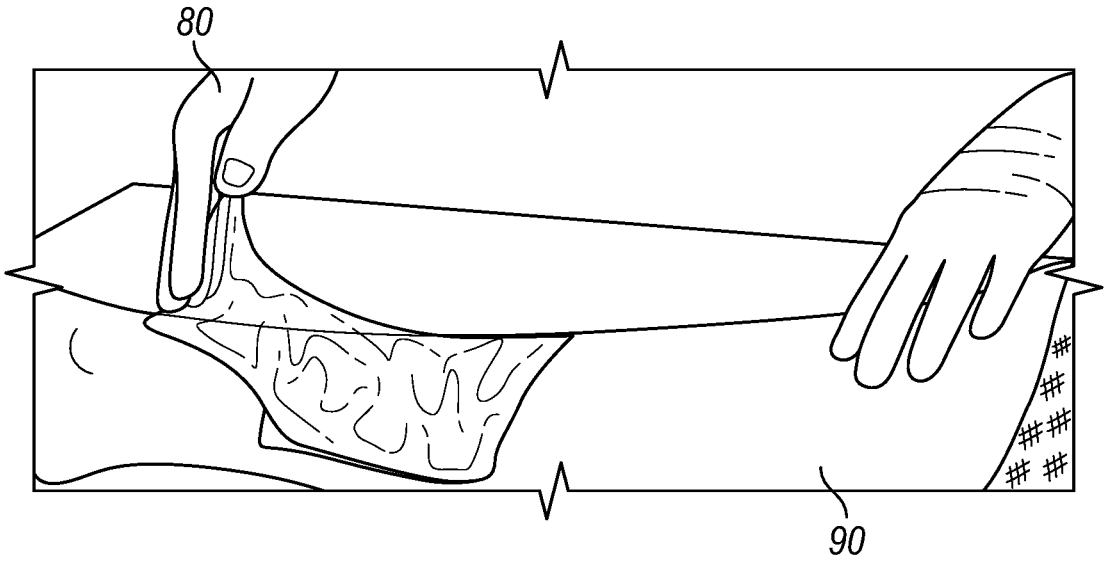
FIG. 17 is a front view showing a "kick off" following the "prepare to flick" of FIG. 16.

FIG. 17 is a front view showing a "kick off" following the "prepare to flick" of FIG. 16.

At step 600, the technician maintains a comfortable relaxed wrist and application position for the "Kick command" while still moving onto the skin past the applied paste. If the technician sees the palm of the application hand, then the technician should not perform step 600, but should attempt to reposition the hand more into the same relaxed position of step 300. If that fails, the technician should start over at step 100.

The technician's fingers must always remain in a parallel position with equal reduced pressure applied by each finger. A kick-back maneuver is executed without lifting the application hand off the sugar paste. The technician preferably issues a voice command to stress the word "KICK", and a voice command to stress the word "Handshake" whilst continuing to gently move on the skin and the a final command of the word "OFF". A firm wrist action is used when performing the "OFF" voice command, with little effort from the technician's shoulder. The "OFF" command should immediately follow the "Handshake" command without the slightest hesitation. If this step is performed incorrectly, then the client may experience discomfort or pain from lifted skin or broken hair. The technician should stay connected to the sugar and skin when "kicking" and when going from a step 300 positioning of the hand.

Second and Consecutive Kick-Off Using "Snap-Back" Action ("the Art of Sugaring")

The technician should immediately snap-back the kicked-off (flicked-off) sugar paste to accumulate it on the client's skin in order to prevent the sugar paste from travelling on the client's skin and to effectively sugar each molded strip while performing professional sugaring treatments. Snap-back will allow the technician to control the sugar paste as it is repeatedly "flicked" off the skin and to prevent it from flying away from the technician's hand and onto the treatment table, the floor and even walls. Snap-back is an intricate part of on-going technique of the 6 Steps to perfect sugaring.

By deciding exactly where one wants to accumulate the "flicked sugar", the technician can perform step 600 and immediately return her sugaring hand connected to the "flicked sugar paste" to the exact pre-determined spot on the skin. This will allow them to accumulate/gather the sugar paste in a small "pile", perform step 100 behind the sugar paste pile to collect it and continue to sugar that strip until it is completely off the skin.

Figure 18:
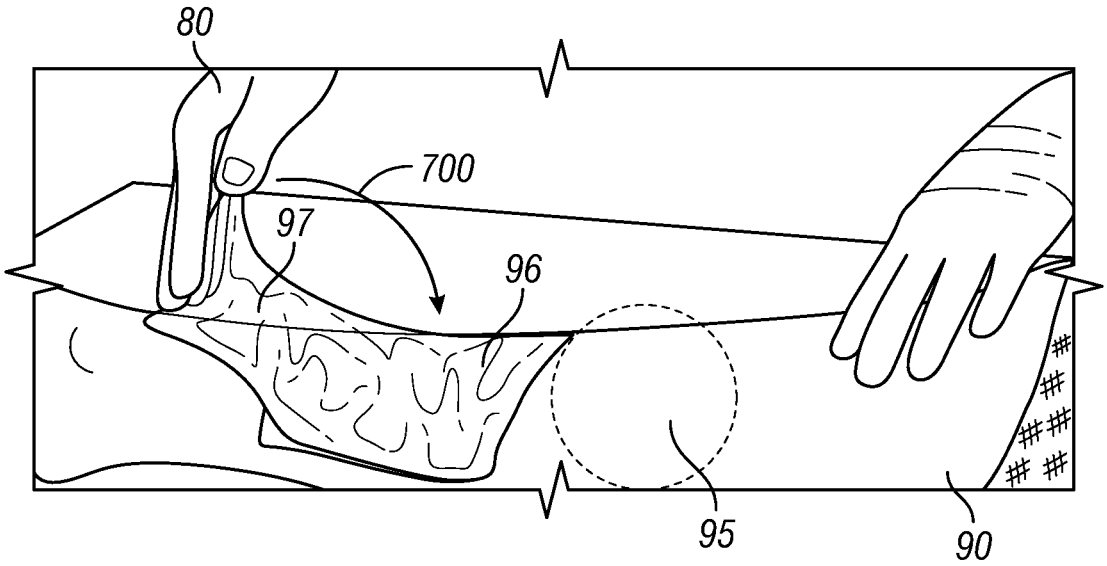
FIG. 18 is an illustration of a "snap back" following the "kick off" of FIG. 17.

FIG. 18 is an illustration of a "snap back" following the "kick off" of FIG. 17. In this figure, the portion 97 of the sugar paste has just been flicked off of area 95 of the leg, and the technician is preparing to "snap back" that portion 97 to area 96 to repeat the "flick" for region 96.

Predetermining where to return the sugaring hand after performing step 600 will help the technician to prevent "travelling on the skin" either in front or behind the applied sugar paste. This will prevent the technician from overworking an area, from getting stuck on the skin and help them to become quicker at the treatment without compromising efficiency.

After each "kick-off" the technician should immediately position the application hand according to step 100 and immediately move to step 300. Step 200 should be eliminated whenever the technician is ready to execute a series of kick off steps. Step 500 (and then step 600) is performed if there is a distance of sugar paste remaining on the skin; and step 600 is performed after step 300 if the sugar paste distance is minimal such as I to 2 inches maximum.

If these steps are performed incorrectly, then the client may experience discomfort or pain from lifted skin or broken hair.

Over performing Step 200 will overwork the sugar paste and likely melt it too much into the skin and get the technician stuck. The technician can cause some irritation from trying to Kick-Off sugar paste that is melted into the skin. This can also cause the technician to become too hot from frustration. If this melting occurs, the technician should simply relax, gently remove the application hand from the sugar paste using Step 400, and continue to sugar in another area. When you leave the melted sugar paste for a few minutes, it will cool down and be easier to remove.

Example—Series of Sugaring Steps on Client Arm

The technician executes steps 100-600 at a first upper portion of the arm with the application hand.

After the application of the sugar paste on a strip of the upper arm and the initial kick-off, the technician brings the hand to the position of step 100 over a second portion of skin slightly lower on the upper arm, collects the sugar paste that was kicked-off by placing the hand just behind the collected paste, and executes steps 300, step 500 and then step 600. These steps are repeated until the applied strip of sugar paste is completely removed from the skin. (Step 200 is eliminated for several successive kick-off sequences, and step 500 is eliminated when there is less than 2 inches distance of paste remaining on the client's skin.)

After the first applied strip of sugar paste is removed and all the hair beneath the applied sugar paste is extracted, the technician brings the hand to the position of step 100 over another section of the upper arm portion of skin and executes steps 300,400,500 and step 600. (Step 200 is eliminated for several successive kick-off sequences, and step 500 is eliminated when there is less than 2 inches distance of paste remaining on the client's skin.)

These steps are repeated until each section of the upper arm is completed and all hair is extracted.

After the upper arm is completed, the technician brings the hand to the position of step 100 over a portion of skin on the underneath part of the lower arm, executes steps 300, 400, 500 and step 600. Afterwards, the same protocol in applying the steps is followed as with the upper arm. Once the underneath portion of the lower arm is completed and all hairs are extracted, the technician then moves to the top forearm. The hair in this portion of the arms grows sideways. The technician follows the natural direction of growth by positioning the hand to step 100 and executes step 200, 300, 400, 500 and step 600 respectively from the outside of the forearm to the inside of the forearm.

After the final kick-off of the first strip applied to the lower top forearm, the technician brings the hand to the position of step 100 over a new portion of the skin on the forearm, and executes steps 100-600.

The technician must always inspect the direction of the hair growth prior to beginning treatments using the 6 Steps. The Kennedy Theory® executes the extraction of hair only in the natural direction of hair growth, and this requires that Steps 100 and 200 be executed against the natural direction for better penetration of the sugar paste and an even gentler execution of step 600.

Each Step has magic to its performance. And, each Step relies on each other for perfect technique performance. When the technician fully understands the relevance of immediate sequencing for some of these Steps, the technician will be able to learn how to effectively extract hair less than I mm by applying T.H.E. Technique™ when it is called upon. (Tough Hair Extraction Technique)

SUMMARY

With some patience the technician can gain experience and to master the magic of Alexandria Professional™ body sugaring hair removal and skin conditioning treatments.

Step 100 provides the technician full control of sugar paste, establishes her positioning onto the skin and the correct pressure.

Step 200 allows the technician to mold/apply the sugar paste without causing pain or discomfort to the client and to seep the sugar paste into the follicle.

Step 300 allows the technician to prepare for either the release of the hand from the sugar and skin, or the removal of the sugar paste without causing pain or discomfort to the client.

Step 400 allows the technician to return to continual Step 2 molding process without causing pain or discomfort.

Step 500 allows the technician to prepare for the removal of the sugar paste without causing pain or discomfort.

Step 600 allows the technician to effectively remove the sugar paste and extract the hair and to perform the "snap-back" without causing pain or discomfort. After each "kick-off" the technician should immediately position the application hand according to step 100 and immediately move to step 300.

Variations

When you are ready to prepare for the Kick-off, you no longer need to perform step 200. If you continue with step 200 every time you perform step 600, then you will overwork the sugar paste and the skin and cause the sugar to melt too much into the skin.

The purpose of step 400 is to correctly release from the sugar paste on the skin without causing discomfort when you are going back to repeat the molding step 200.

You only need to use step 500 when there is enough sugar paste molded onto the skin for you to "roll past" in preparation for the Kick-Off If there is only a small piece of sugar paste such as the very last Kick-Off, then you do not use step 500, but perform steps 100, 300, and 600.

Non-Permissible Variations in Preferred Embodiment

In the preferred embodiment, the sugaring technique is disciplined and several variations are non-permissible.

Every time that you return to/on the skin, you should be in the handshake position of step 100, even if you are "cleaning up" the skin.

Every time that you are ready to either release from the sugar paste, or to get ready to remove the sugar paste, you must perform step 300.

Every time you are taking sugar paste OFF the skin, you must use step 600, and be in a handshake position. This includes Kick-Offs and clean-ups.

Figure 19:
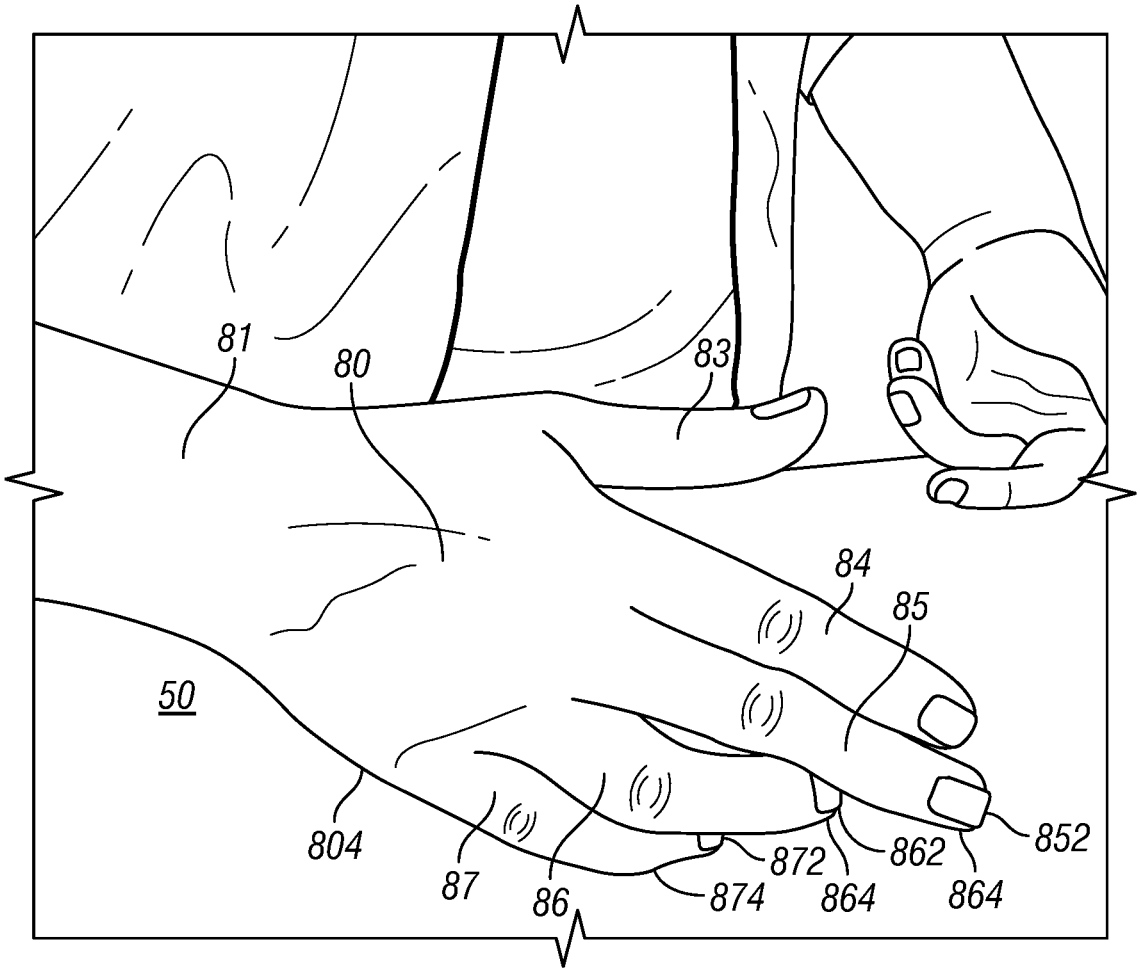
FIG. 19 is a right side perspective view a right hand held in a first orientation for applying a sugaring composition.

FIG. 19 is a right side perspective view a right hand 80 held in a first orientation for applying a sugaring composition. In this case the right hand 80 is held aligned with the wrist 82.

The index finger 84 and the middle finger 85 are extended outwardly from the hand, and the right portion 854 of the tip 852 of the middle finger is resting lightly on the surface 50. In this example, the index finger 84 and the middle finger 85 are straight, and angled toward the palm at an angle of approximately 20-30 degrees so that the tip 852 of the middle finger is comfortably resting on the surface 50.

The ring finger 86 and little finger 87 are bent so that the right portion 874 of the tip 872 of the little finger, the right portion 864 of the tip 862 of the ring finger, and right portion 874 of the tip 872 of the middle finger are aligned and resting comfortably on the surface. This alignment of the tips of the bent little finger, bent ring finger, and angled middle finger creates a dam for containing the sugar paste composition as the hand is drawn in a backward direction along the surface to initially apply the composition.

In this orientation, the distal portion of the right side base of the hand 804 is maintained in contact with the surface. This contact further contains the sugar composition.

In sugaring application, the surface 50 would be a portion of a human body such as a leg, arm, or torso.

Figure 20:
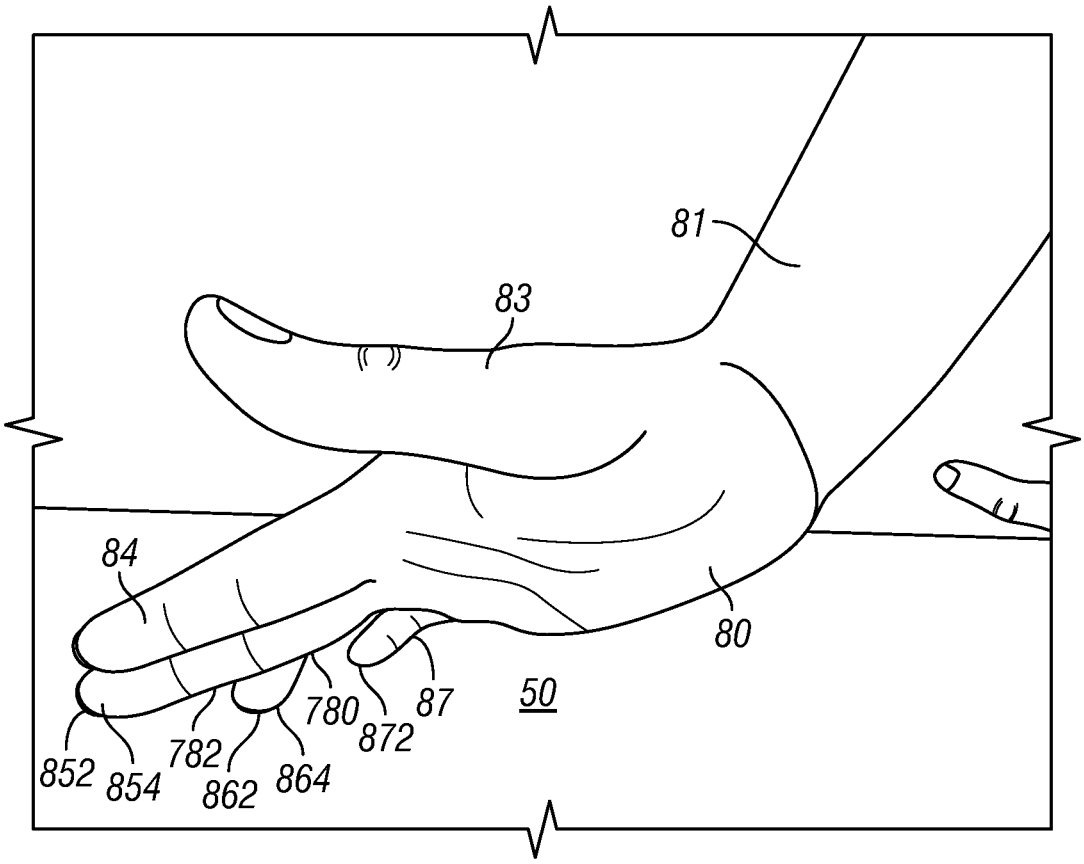
FIG. 20 is a rear left side perspective view a right hand held in a second orientation for applying a sugaring composition.

FIG. 20 is a rear left side perspective view a right hand 80 held in a second orientation for applying a sugaring composition. In this case the fingers and thumb are maintained in the orientation described in FIG. 19 with the right side tips of the little finger, ring finger, and middle finger in contact with the surface. The distal portion of the right side base of the hand is raised above the surface by about one half inch.

As the right side base of the hand is raised above the surface, a first separation 876 is created between the tip of the little finger and the tip of the ring finger; and a second separation 866 is created between the tip of the ring finger and the tip of the middle finger.

This alignment of the tips of the bent little finger, bent ring finger, and angled middle finger facilitates spreading the sugar paste composition as the hand is drawn in a backward direction along the surface to initially apply the composition.

Figures 21A, 21B:
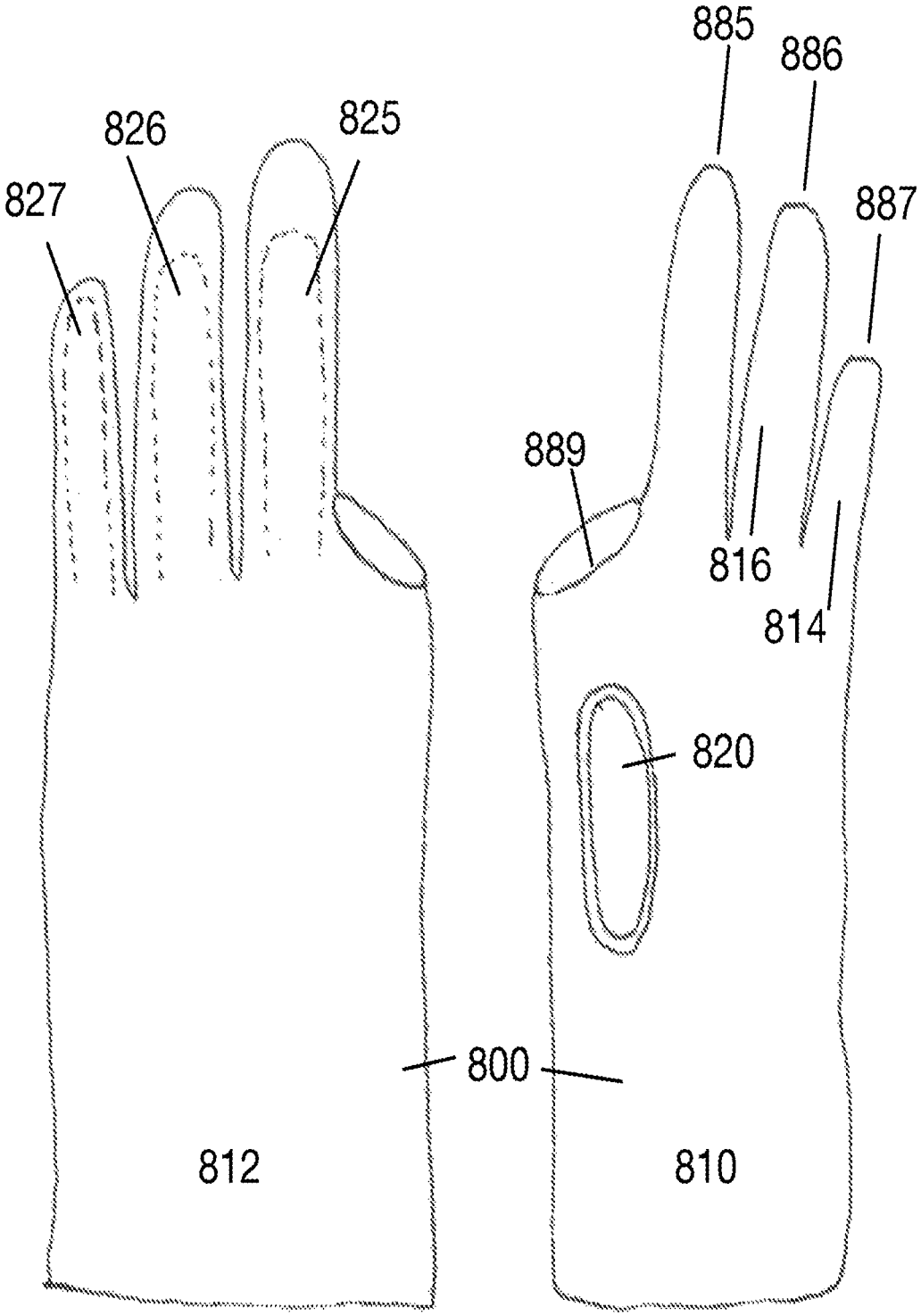
FIG. 21 is a top perspective view a right hand held in a third orientation for applying a sugaring composition.

FIG. 21 is a top perspective view a right hand 80 held in an orientation for applying a sugaring composition.

Training Glove

Establishing and maintaining the desired finger positions 1*s* important for proper sugaring technique. The failure to maintain the proper finger positions can cause discomfort and can reduce the efficiency of the process. It is difficult to teach and to learn these finger positions. One way to improve the learning process is to provide a glove or other training device that assists the technician in maintaining the proper finger positions.

Figure 22B:
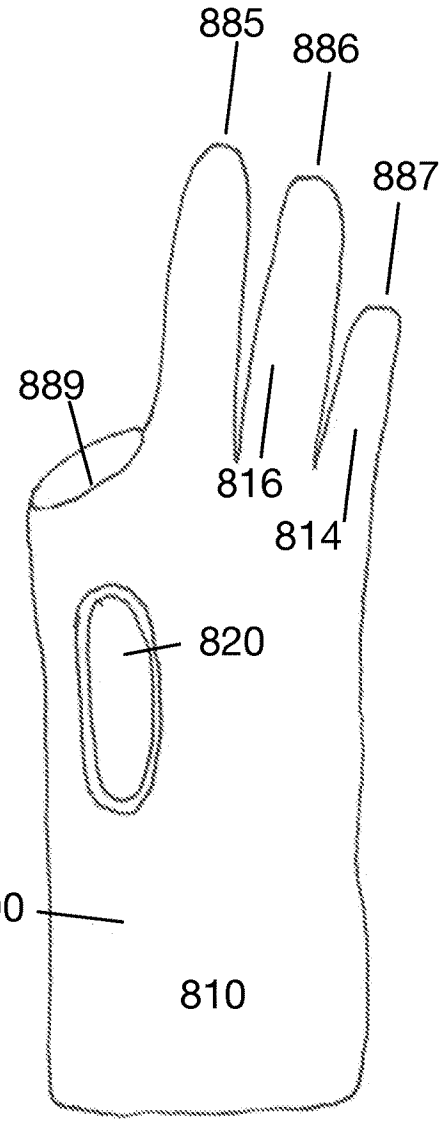
FIG. 22B is a palm-side view of the training glove embodiment of FIG. 22A.
Figure 22A:
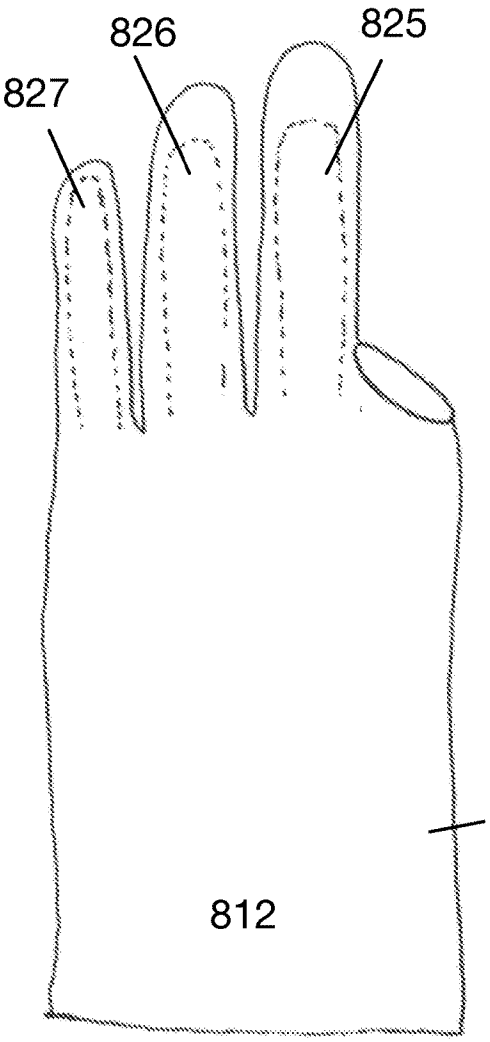
FIG. 22A is a back-of-hand view of a training glove embodiment.

FIG. 22A is a back-of-hand view of a training glove 800 embodiment showing the back side of a glove 812. FIG. 22B is a palm-side 810 view of the training glove embodiment of FIG. 22A In this example, the thumb and index finger are not constrained by the glove. The thumb is inserted through opening 820, and the index finger is exposed through opening 889.

The glove includes a little finger portion 887, a ring finger portion 886, and a middle finger portion 885. In some examples, these finger portions are completely enclosed. In other examples, the finger tips are exposed.

In this example, the back side of the glove includes slot 825 for insertion of a middle finger alignment guide, slot 826 for insertion of a ring finger alignment guide, and slot 827 for insertion of a little finger alignment guide. These alignment guides keep the middle finger, the ring finger, and the little finger in a desired curvature as shown in FIG. 20.

Figure 26:
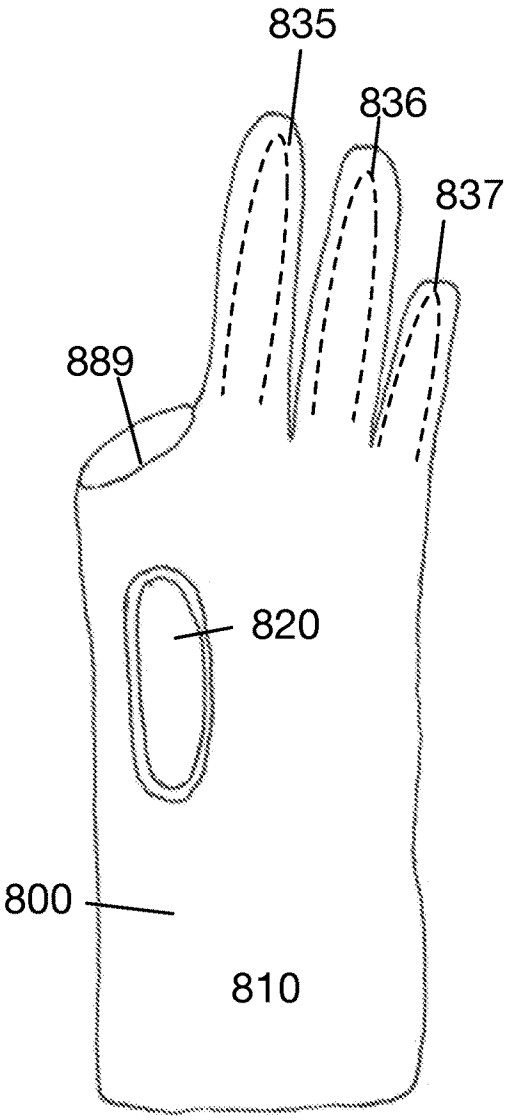
FIG. 26 is a palm-side view of a training glove embodiment.

In other examples, individual finger inserts are provided on the palm side of the fingers. FIG. 26 is a palm-side view of a training glove embodiment with finger alignment guides 835, 836, and 837.

Figure 25:
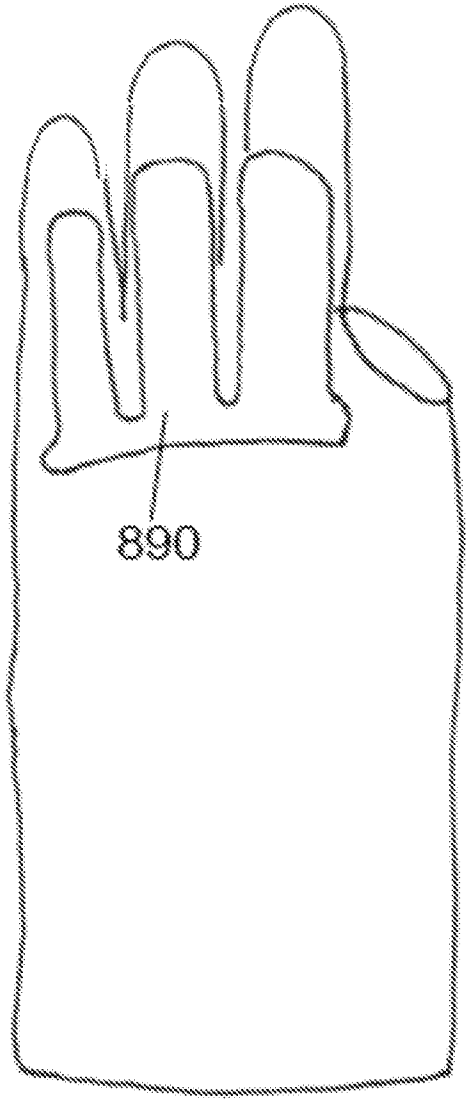
FIG. 25 is a back-of-hand view of a training glove embodiment with a single finger alignment insert form.

In other examples, a single insert form is provided to position all three fingers—the middle finger, the ring finger, and the little finger. FIG. 25 is a back-of-hand view of a training glove embodiment with a single finger alignment insert form 890.

One advantage to the single finger inserts, or to the multiple finger form, is the ability to help double-jointed technicians establish proper finger positioning. In this example, the desired position of the little finger and ring finger requires bending the ring finger or the little finger at both knuckles, and double-jointed persons have difficulty maintaining a desired bend at both knuckles. The guide guides help to hold the desired bent-finger positions.

In addition to establishing the desired finger bending, the individual finger inserts or the single inset form position the fingers so that the outside tips of the middle finger, ring finger, and little finger are properly aligned. This alignment helps to apply an appropriate pressure to the skin in a sugaring application.

Figure 24:
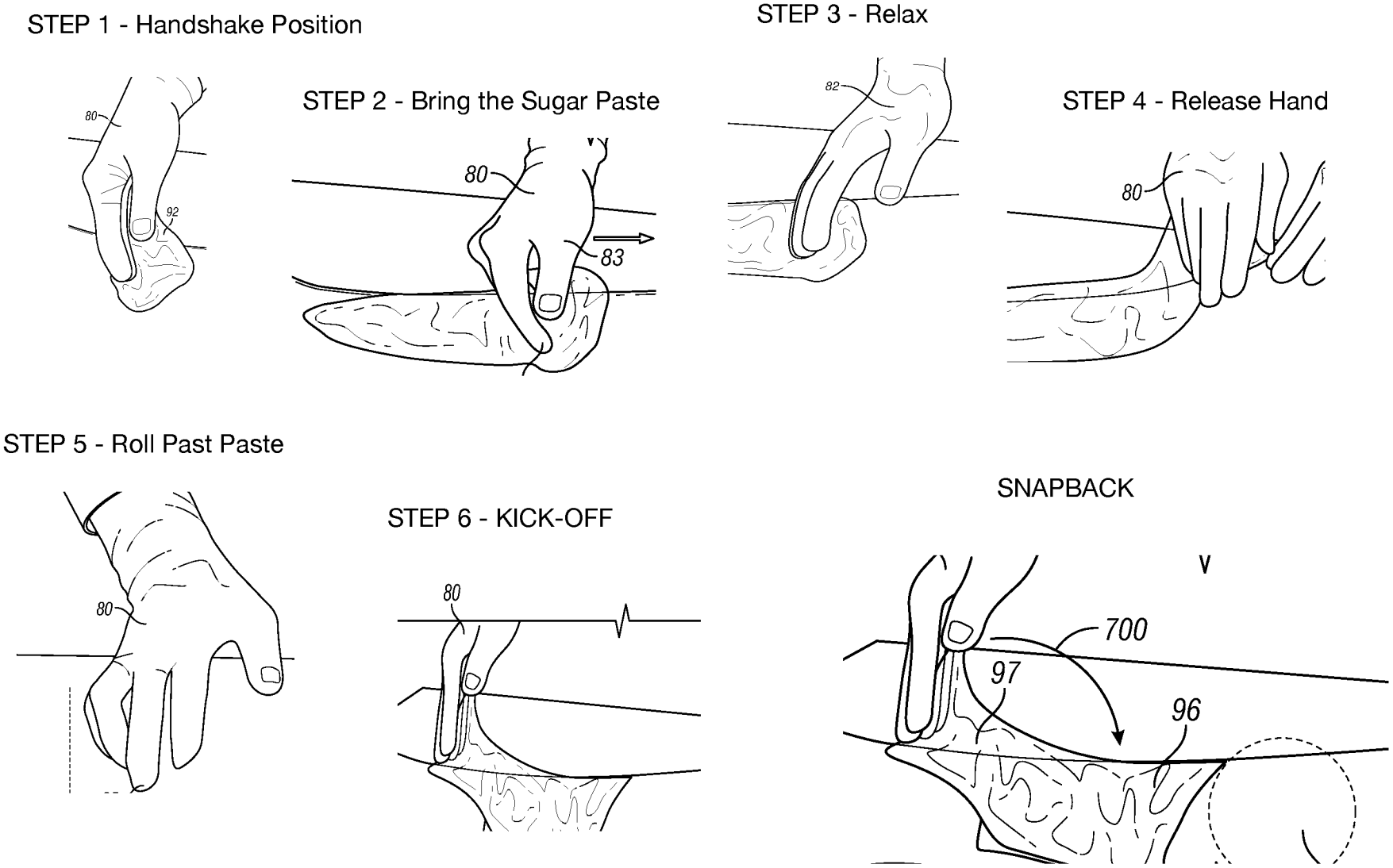
FIG. 24 illustrates the 6 Steps to Perfect Sugaring.

FIG. 23 summarizes the 6 Steps to Perfect Sugaring. FIG. 24 illustrates the 6 Steps to Perfect Sugaring. In one example, a glove with finger inserts is used to establish and maintain the desired finger positions for the middle finger, ring finger, and little finger throughout the 6 steps.

The glove may be used for an initial training period, until the technician has established the habit of proper finger positioning. The glove may also be used on a routine basis after initial training.

While exemplary embodiments of the invention have been described, it should be apparent that modifications and variations thereto are possible, all of which fall within the true spirit and scope of the invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A training glove for teaching proper hand and finger positioning of a technician's little finger, ring finger, and middle finger while performing a sugaring hair removal procedure, the training glove comprising:

a front side comprising a palm portion, a palm side little finger portion, a palm side ring finger portion, and a palm side middle finger portion;

a back side comprising a back of hand portion, a back of hand little finger portion, a back of hand ring finger portion, and a back of hand middle finger portion;

a thumb portion with an opening configured to receive a thumb therethrough, and an index finger portion with an opening configured to receive an index finger therethrough such that the technician's thumb and index finger are completely uncovered and not constrained when the glove is worn;

a little finger portion comprising a distal portion and a bent little finger alignment guide positioned within the little finger portion, said guide adapted to establish and maintain a technician's little finger orientation concave with respect to the technician's palm, at two knuckles of the technician's little finger, and a slot on the back side of the little finger portion, wherein said slot is configured to allow for insertion and removal of said bent little finger alignment guide;

a ring finger portion comprising a distal portion and a bent ring finger alignment guide positioned within the ring finger portion, said guide adapted to establish and maintain a technician's ring finger orientation concave with respect to the technician's palm, at two knuckles of the technician's ring finger, and a slot on the back side of the ring finger portion, wherein said slot is configured to allow for insertion and removal of said bent ring finger alignment guide;

a middle finger portion comprising a distal portion and a bent middle finger alignment guide positioning within the middle finger portion, said guide adapted to position the technician's middle finger in a manner that aligns the technician's little fingertip, ring fingertip, and middle fingertip when the little fingertip, ring fingertip, and middle fingertip are spaced apart and contacting a surface, and a slot on the back side of the middle finger portion, wherein said slot is configured to allow for insertion and removal of said bent middle finger alignment guide.

2. The training glove of claim 1 further comprising an opening in the distal portion of the little finger portion, the opening adapted to expose the tip of the technician's little finger;

an opening in the distal portion of the ring finger portion, the opening adapted to expose the tip of the technician's ring finger, and an opening in the distal portion of the middle finger portion, the opening adapted to expose the tip of the technician's middle finger.

* * * * *